US009896255B2

(12) United States Patent
Okura

(10) Patent No.: US 9,896,255 B2
(45) Date of Patent: Feb. 20, 2018

(54) PACKAGING MEMBER

(71) Applicant: KYOCERA Document Solutions Inc., Osaka (JP)

(72) Inventor: Yoshimasa Okura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/249,717

(22) Filed: Aug. 29, 2016

(65) Prior Publication Data

US 2017/0073138 A1 Mar. 16, 2017

(30) Foreign Application Priority Data

Sep. 16, 2015 (JP) ..... 2015/183181

(51) Int. Cl.
*B65D 81/00* (2006.01)
*B65D 5/00* (2006.01)
(Continued)

(52) U.S. Cl.
CPC ..... *B65D 81/05* (2013.01); *B65D 5/02* (2013.01); *B65D 5/4266* (2013.01); *B65D 5/505* (2013.01);
(Continued)

(58) Field of Classification Search
CPC ..... B65D 5/02; B65D 5/42; B65D 5/4266; B65D 5/50; B65D 5/5007; B65D 5/5028; B65D 5/503; B65D 5/5035; B65D 5/504; B65D 5/505; B65D 5/5069; B65D 5/64; B65D 19/20; B65D 81/04; B65D 81/05; B65D 2519/00019; B65D 2519/00054; B65D 2519/00159; B65D 2519/00194;
(Continued)

(56) References Cited

U.S. PATENT DOCUMENTS 2,438,879 A * 3/1948 Whitehead ..... B65D 5/5007 206/521
3,895,754 A * 7/1975 Rosenburg, Jr. ..... B65D 5/32 206/521
(Continued)

FOREIGN PATENT DOCUMENTS

JP 2-127265 A * 5/1990 ..... B65D 81/04
JP 2005-022680 A 1/2005
JP 2006-168747 A 6/2006

*Primary Examiner* — Bryon Gehman
(74) *Attorney, Agent, or Firm* — Studebaker & Brackett PC

(57) ABSTRACT

A packaging member includes a packaging box and an intermediate buffering member. The intermediate buffering member is provided in a space formed between a bottom plate and a side plate of the packaging box and a main body part of the article. The intermediate buffering member has a vertical direction supporting part and a positioning part. The vertical direction supporting part abuts against a lower face of the main body part and the bottom plate. The positioning part is coupled with the vertical direction supporting part. The positioning part prevents the vertical direction supporting part from being moved toward the side plate. The vertical direction supporting part has an inclined part extending from the lower face of the main body part in an oblique lower direction toward near a lower corner between the bottom plate and the side plate and abutting against the bottom plate.

8 Claims, 6 Drawing Sheets

(51) Int. Cl.

| | |
|---|---|
| ***B65D 81/05*** | (2006.01) |
| ***B65D 5/02*** | (2006.01) |
| ***B65D 5/42*** | (2006.01) |
| ***B65D 5/50*** | (2006.01) |
| ***B65D 5/64*** | (2006.01) |
| ***B65D 19/20*** | (2006.01) |

(52) U.S. Cl.
CPC ..... *B65D 5/5028* (2013.01); *B65D 5/5069* (2013.01); *B65D 5/64* (2013.01); *B65D 19/20* (2013.01); *B65D 2519/00019* (2013.01); *B65D 2519/00054* (2013.01); *B65D 2519/00159* (2013.01); *B65D 2519/00194* (2013.01); *B65D 2519/00273* (2013.01); *B65D 2519/00288* (2013.01); *B65D 2519/00318* (2013.01); *B65D 2519/00497* (2013.01); *B65D 2585/6892* (2013.01)

(58) Field of Classification Search
CPC ..... B65D 2519/00273; B65D 2519/00288; B65D 2519/00318; B65D 2519/00497; B65D 2585/6892
USPC ..... 206/521, 523
See application file for complete search history.

(56) References Cited

U.S. PATENT DOCUMENTS

| | | | | |
|---|---|---|---|---|
| 7,780,010 | B2 * | 8/2010 | Kinuhata | B65D 5/504 206/590 |
| 2009/0000978 | A1 * | 1/2009 | Li | B65D 5/5035 206/521 |

* cited by examiner

PACKAGING MEMBER

INCORPORATION BY REFERENCE

This application is based on and claims the benefit of priority from Japanese Patent application No. 2015-183181 filed on Sep. 16, 2015, the entire contents of which are incorporated herein by reference.

BACKGROUND

The present disclosure relates to a packaging member configured to package an article to be packaged.

In an image forming apparatus such as a copying machine or a printer, there may be a case in which a post-processing device to carry out stapling processing or punching processing on a sheet on which an image is formed is attached as an optional device. Such a post-processing device is disposed on a side of a sheet ejecting port of the image forming apparatus. Since the sheet ejecting port is usually formed at an upper portion of the image forming apparatus, a main body part to carry out stapling processing or punching processing is supported by a leg part at a same height as that of the sheet ejecting port.

Incidentally, when an article to be packaged, such as the image forming apparatus or the post-processing device, is packaged in a packaging box, in order to absorb an impact acting on the article to be packaged at the time of transportation or storage, a buffering member is interposed between the article to be packaged and the packaging box. Ina case where the image forming apparatus as the article to be packaged is packaged in the packaging box, there may be often a case in which a buffering member made of a pulp mold is interposed between upper corners and lower corners of the image forming apparatus and the packaging box.

In addition, in a case where an article to be packaged, having a high center of gravity, such as the post-processing device, is packaged in the packaging box, a buffering member is interposed not only between the periphery of the post-processing device and the packaging box but also between the main body part of the article and a bottom face of the packaging box so as to absorb an impact acting on the main body part at the time of dropping.

However, in a case where the post-processing device is packaged in the packaging box as described above, for example, if the packaging box is dropped with an upright posture, the impact acting on the main body part is absorbed by the buffering member interposed between the main body part and the bottom face of the packaging box; and however, if the packaging box is dropped with an oblique posture, it is impossible to sufficiently absorb an impact acting on the main body part from obliquely below by the buffering member interposed between the main body part and the bottom face of the packaging box.

SUMMARY

In accordance with an embodiment of the present disclosure, a packaging member includes a packaging box and an intermediate buffering member. The packaging box is configured to house an article to be packaged. The packaging box has a bottom plate and a side plate erected from one edge of the bottom plate. The article has a main body part and a leg part configured to support the main body part. The intermediate buffering member is provided in a space formed between the bottom plate and the side plate of the packaging box and the main body part of the article, inside of the packaging box. The intermediate buffering member has a vertical direction supporting part and a positioning part. The vertical direction supporting part abuts against a lower face of the main body part and the bottom plate. The positioning part is coupled with the vertical direction supporting part. The positioning part prevents the vertical direction supporting part from being moved toward the side plate. The vertical direction supporting part has an inclined part extending from the lower face of the main body part in an oblique lower direction toward near a lower corner between the bottom plate and the side plate and abutting against the bottom plate.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a packaging member according to an embodiment of the present disclosure will be described with reference to the drawings.

Figure 1:
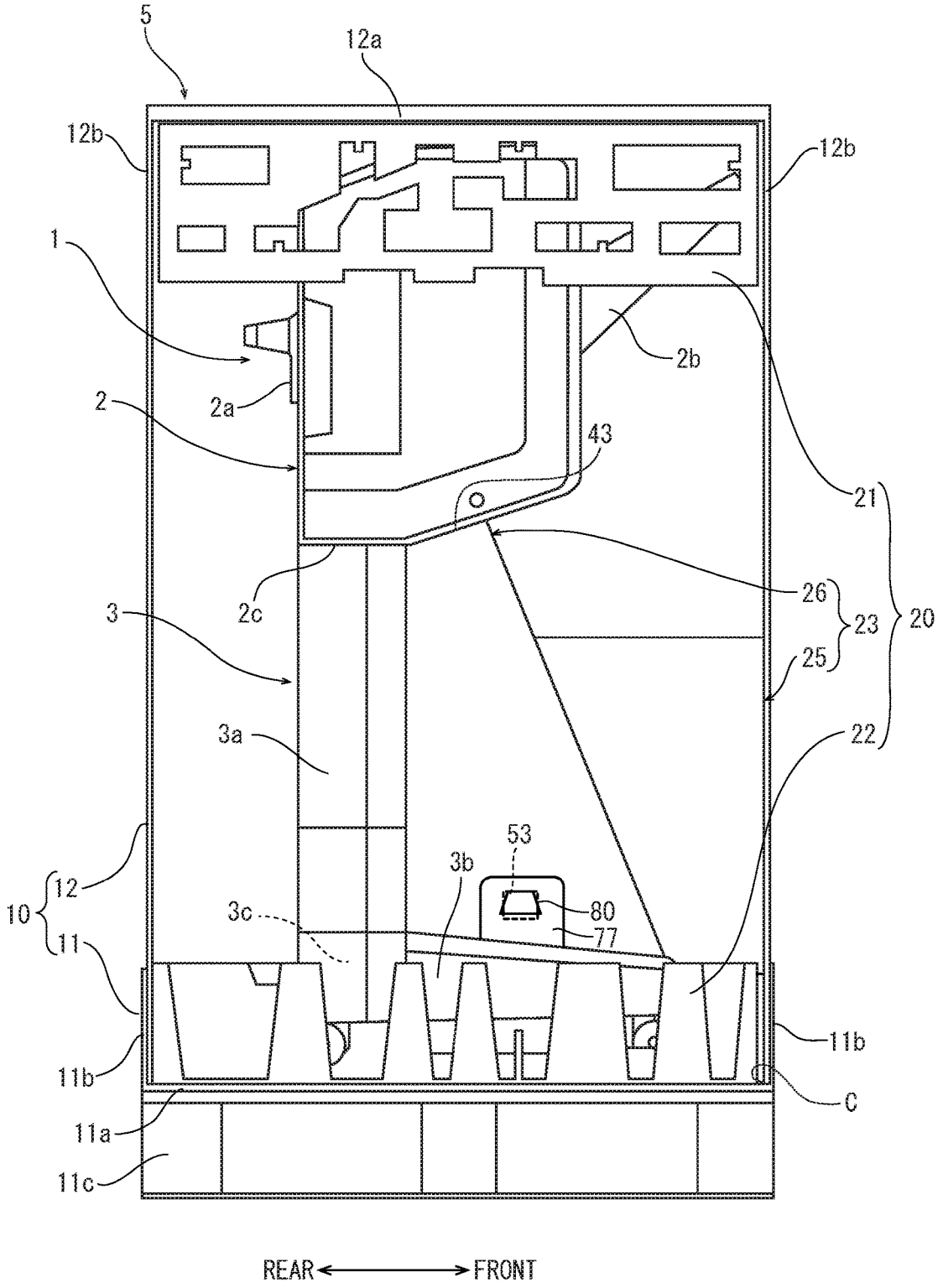
FIG. 1 is a side view showing a packaging member according to an embodiment of the present disclosure.
Figure 2:
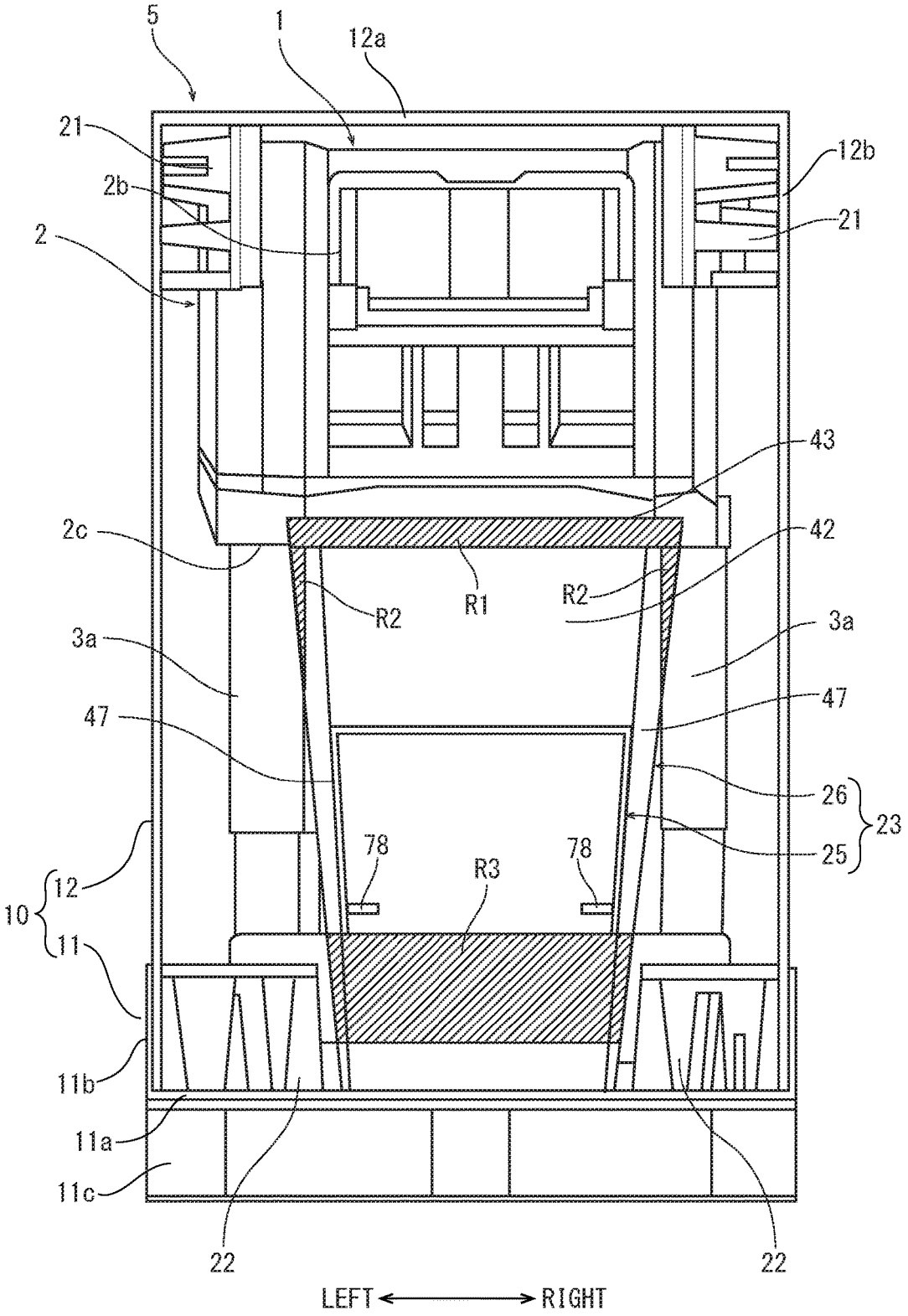
FIG. 2 is a front view showing the packaging member according to the embodiment of the present disclosure.

As shown in FIG. 1 and FIG. 2, a packaging member 5 according to an embodiment of the present disclosure includes: a packaging box 10 to house a post-processing device 1 which is the article to be packaged; and a buffering member 20 interposed between the packaging box 10 and the post-processing device 1. FIG. 1 and FIG. 2 each are a view showing the post-processing device housed in the packaging box, wherein FIG. 1 is a side view thereof and FIG. 2 is a front view thereof. In the following description, left and right directions are based on a direction in which the post-processing device 1 is viewed from a front side.

First, the post-processing device 1 will be described. The post-processing device 1 includes: a main body part 2 configured to carry out post-processing on a sheet ejected from an image forming apparatus; and a leg part 3 configured to support the main body part 2.

The main body part 2 has a substantially rectangular parallelepiped shape. On a rear face facing the image forming apparatus, a receiving port 2*a* into which a sheet ejected from the image forming apparatus is received is formed. On a front face, an ejecting tray 2*b* is supported. Inside of the main body part 2, a sheet conveying path configured to convey the sheet from the receiving port 2*a* toward the ejecting tray 2*b* is formed. In the middle of the sheet conveying path, a processing device to carryout post-processing such as stapling processing or punching processing is provided. Also, a lower face 2*c* of the main body part 2 has a rear side flat face and a front side upward inclined face.

The leg part 3 has: a pair of left and right columns 3*a*; a supporting member 3*b* horizontally extending from a lower end portion of a front face of each column 3*a*; and a coupling member 3*c* to couple the lower ends of each columns 3*a*. Upper ends of the columns 3*a* are fixed to both side end portion of the rear side flat face of the lower face 2*c* of the main body part 2. On a lower face of each supporting member 3*b*, a caster is rotatably supported. With such a construction, the post-processing device 1 has a structure in which a center of gravity is positioned in the upper main body part 2.

Next, the packaging box 10 will be described. The packaging box 10 includes a skid 11 and a lid case 12 to be inserted into the skid 11. The skid 11 has: a rectangular bottom plate 11*a*; side plates 11*b* erected from each edge of the bottom plate 11*a*; and a foot truss 11*c* fixed to a lower face of the bottom plate 11*a*. The foot truss 11*c* is formed by combining corrugated board skids into a lattice shape so as to engage with an engaging hook of a forklift. The lid case 12 has: side plates 12*b* to be inserted inside the side plates 11*b* of the skid 11; and flaps 12*a* connected to upper edges of the side plates 12*b*. The side plates 12*b* of the lid case 12 are inserted inside the side plates 11*b* of the skid 11 and then the side plates 12*b* of the lid case 12 and the side plates 11*b* of the skid 11 are coupled to each other, and the packaging box 10 is thereby assembled.

Figure 3:
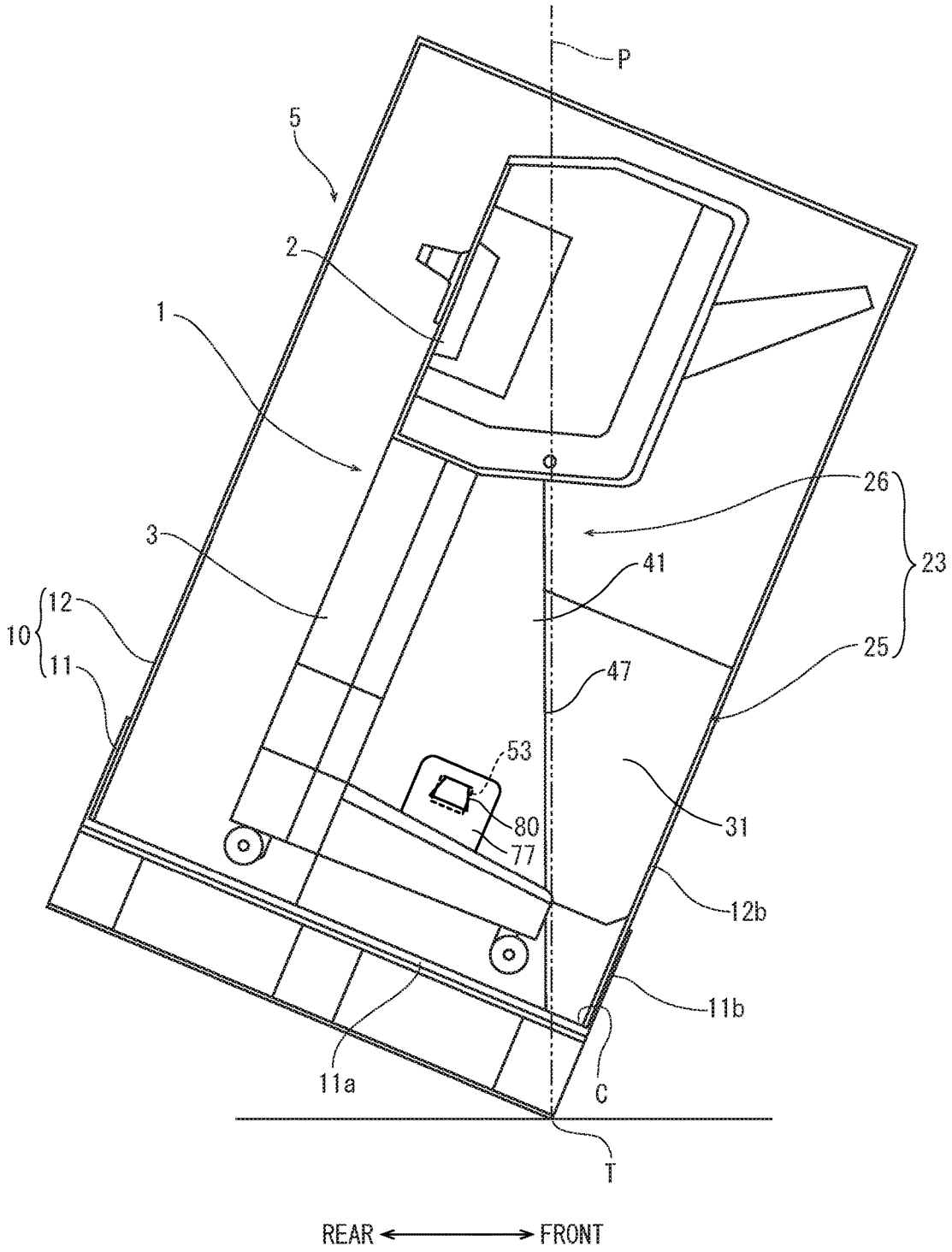
FIG. 3 is a side view showing the packaging member inclined around its lower edge into a balanced posture, according to the embodiment of the present disclosure.
Figure 4A:
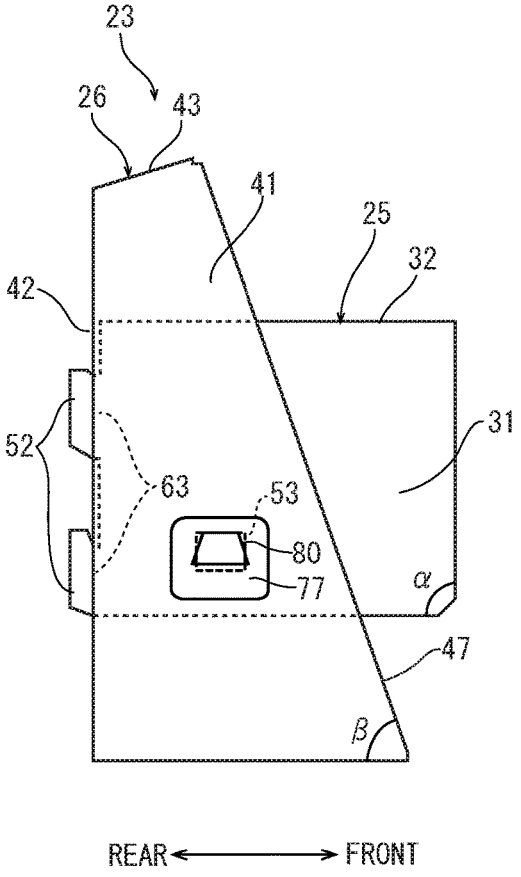
FIG. 4A is a side view showing an intermediate buffering member of the packaging member according to the embodiment of the present disclosure.
Figure 4B:
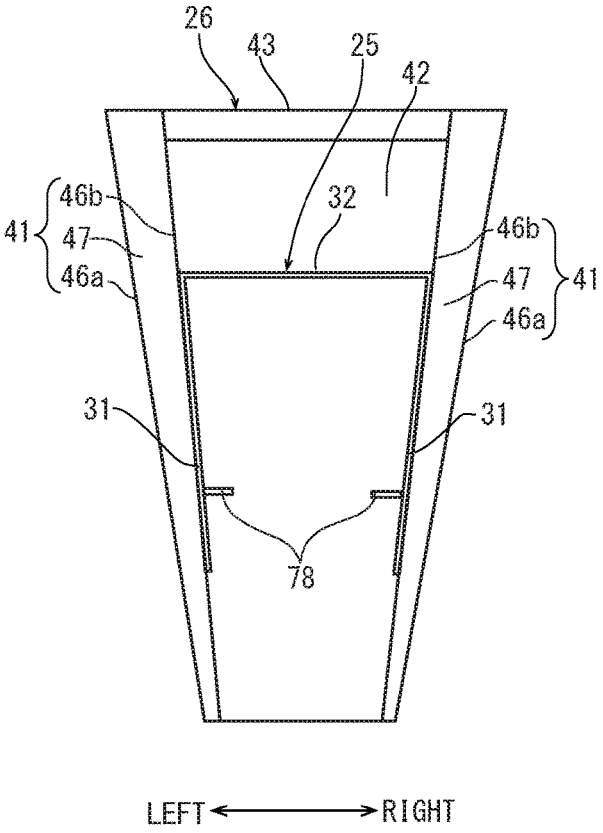
FIG. 4B is a front view showing the intermediate buffering member of the packaging member according to the embodiment of the present disclosure.
Figure 5:
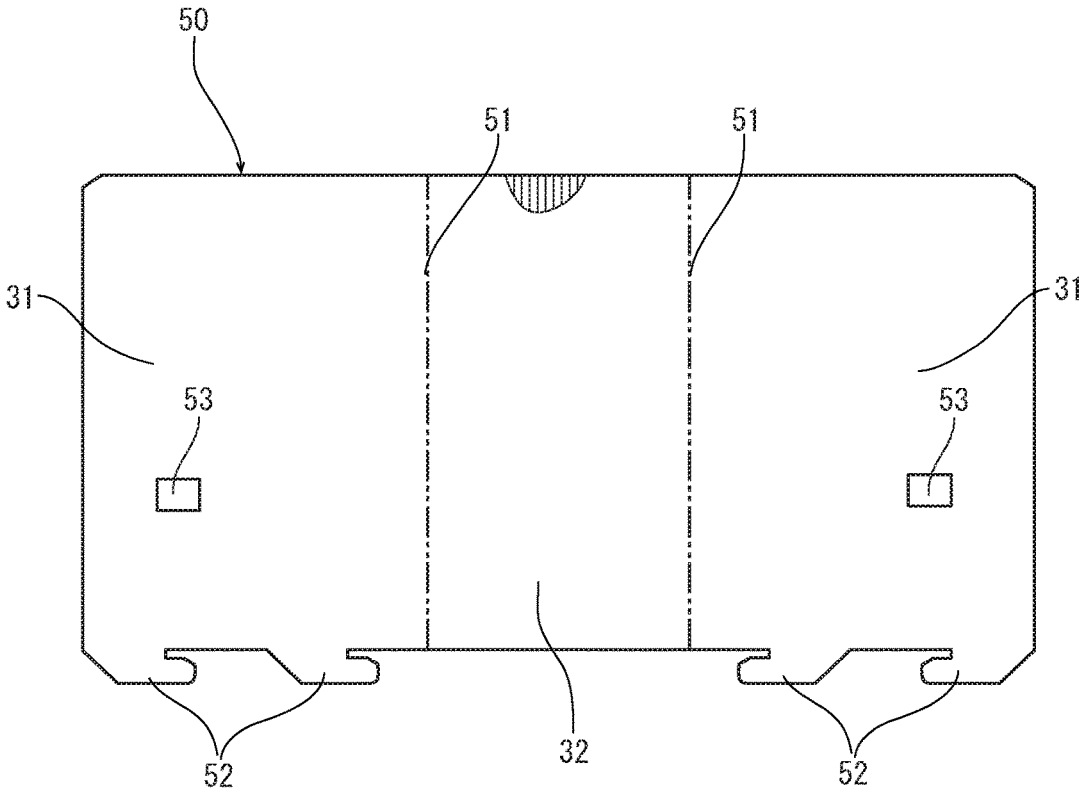
FIG. 5 is an exploded view of a positioning part of the intermediate buffering member in the packaging member according to the embodiment of the present disclosure.
Figure 6:
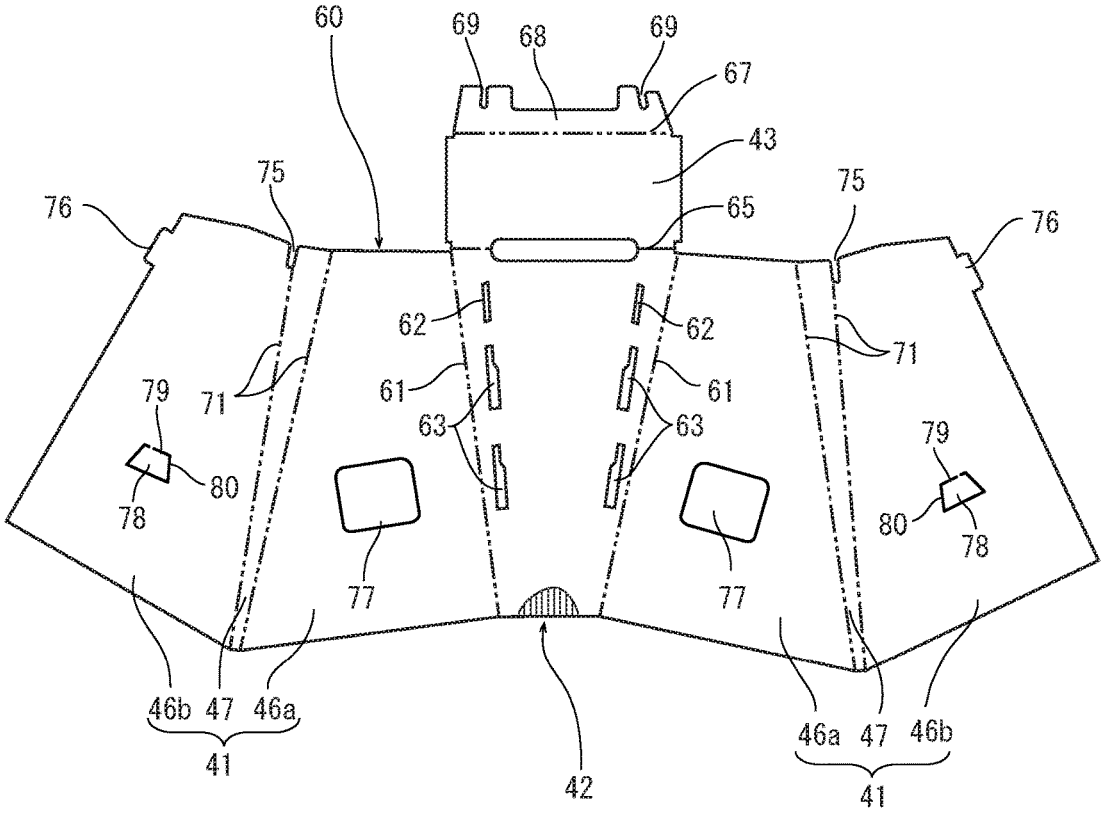
FIG. 6 is an exploded view of a vertical direction supporting part of the intermediate buffering member in the packaging member according to the embodiment of the present disclosure.

Next, the buffering member 20 will be described with reference to FIG. 1 and FIG. 2 and FIG. 3 to FIG. 6. FIG. 3 is a side view showing the packaging box in a balanced posture; FIG. 4A is a side view showing an intermediate buffering member; FIG. 4B is a front view showing the intermediate buffering member; FIG. 5 is an exploded view of a positioning member; and FIG. 6 is an exploded view of a vertical direction supporting part.

The buffering member 20, as shown in FIG. 1 and FIG. 2, has: a pair of upper buffering members 21 to be interposed between the main body part 2 and the lid case 12; a pair of lower buffering members 22 to be interposed between the leg part 3 and the skid 11; and an intermediate buffering member 23 to be interposed between the main body part 2 and the skid 11.

The pair of upper buffering members 21 are interposed between an upper left corner and an upper right corner of the main body part 2 and the lid case 12. The pair of lower buffering members 22 are interposed between the supporting members 3*b* of the leg part 3 and the skid 11. The pair of upper buffering members 21 and the pair of lower buffering members 22 are made of a pulp mold, for example.

The intermediate buffering member 23 is disposed between the pair of supporting members 3*b* and the coupling member 3*c* of the leg part 3 and is interposed between the lower face of the main body part 2 and a lower corner C between the bottom plate 11*a* and the side plate 11*b* crossing each other on the front side of the skid 11. The intermediate buffering member 23 has: a positioning part 25 abutting against the front side plate 11*b*; and a vertical direction supporting part 26 provided on the rear side (the post-processing device 1 side) of the positioning part 25 and abutting against the lower face 2*c* of the main body part 2 and the bottom plate 11*a* of the skid 11.

As shown in FIG. 4A and FIG. 4B, the positioning part 25 is formed by: a pair of side walls 31 opposing to each other in the left and right directions; and a top wall 32 provided between upper edges of the side walls 31. The positioning part 25 is formed into an inverted trapezoidal sectional shape with the lower face opened. Each side wall 31 has a horizontally elongated rectangular shape. The top wall 32 has a horizontally elongated rectangular shape. An angle a between a horizontal plane and a front side edge of each side wall 31 is at a right angle.

The vertical direction supporting part 26 has a height higher than that of the positioning part 25. The vertical direction supporting part 26 is formed by: a pair of dual structured side walls 41 opposing to each other in the left and right directions; an end wall 42 provided between rear edges of the side walls 41; and a top wall 43 provided between upper edges of the side walls 41. The vertical direction supporting part 26 has a hollow space with the front side and the lower side opened. Each side wall 41 has a substantially trapezoidal shape. The end wall 42 has an inverted trapezoidal shape. The top wall 43 has a rectangular shape. Each side wall 41 has a dual structure as described previously, and is formed by: a first side part 46*a* and a second side part 46*b* opposing to each other in the left and right directions; and an inclined part 47 which is a front side end face. An angle β between a horizontal plane and the inclined part 47 is at an acute angle, and is 60±5°, for example.

The positioning part 25 and the vertical direction supporting part 26 are assembled such that the positioning part 25 is housed in the hollow space of the vertical direction supporting part 26 and then engaged with each other. The positioning part 25 and the vertical direction supporting part 26 each are formed of a plate shaped packaging material such as a corrugated cardboard.

The positioning part 25, as shown in FIG. 5, is formed by folding a corrugated cardboard 50 of a horizontally elongated rectangular shape with the direction of the corrugated ridges directed in the vertical direction. The corrugated cardboard 50 is divided by two parallel vertical folding lines 51 into the top wall 32 on the center and the side walls 31 on the both sides. The folding lines 51 is directed along the direction of the corrugated ridges of the corrugated cardboard. Along one edge (lower edge in FIG. 5) of the edges perpendicular to the vertical folding lines 51 of each side wall 31, two hook pieces 52 are formed at a predetermined interval. Also, each side wall 31 is formed with a rectangular coupling opening 53 inside of one hook piece 52. By mountain-folding along each folding lines 51, the corrugated cardboard 50 is assembled so as to have a reverse trapezoid-shaped section and then to form the positioning part 25. When the positioning part 25 takes a posture with an opened face directed downward and with the edges formed with the hook pieces 52 directed on the rear side (refer to FIG. 4A), the angle a of a front side lower corner of each side wall 31 is a right angle.

The vertical direction supporting part 26, as shown in FIG. 6, is formed by folding a horizontally elongated corrugated cardboard 60 with the direction of the corrugated ridges directed in the vertical direction. The corrugated cardboard 60 is divided by two vertical folding lines 61 into the end wall 42 on the center and the side walls 41 on the both sides. The end wall 42 is directed vertically parallel to the direction of the corrugated ridges. The two vertical folding lines 61 extend close to each other downward so that the end wall 42 is formed into a reverse trapezoid-shaped section. The end wall 42 is formed with a first engaging hole 62 and two second engaging holes 63 from the upper side inside of each vertical folding line 61. The second engaging holes 63 are spaced from each other at a predetermined distance along the vertical folding line 61. Also, at an upper edge of the end wall 42, a top wall 43 is connected via a horizontal folding line 65. At a tip end edge of the top wall 43, an engaging piece 68 is connected via a horizontal folding line 67. The engaging piece 68 is formed with notches 69 at both ends of the tip end edge.

Each side wall 41 is divided by two center vertical folding lines 71 into the inclined part 47, the first side part 46*a* inside of the inclined part 47 and the second side part 46*b* outside of the inclined part 47. The two vertical folding lines 71 extend close to each other downward so that the inclined part 47 is formed into a reverse trapezoid shape. The first side part 46*a* is formed with a rectangular through opening 77 at a substantial center portion. The second side part 46*b* is formed with a coupling piece 78 at a substantial center portion. The coupling piece 78 has a trapezoidal shape gradually widened downward. The coupling piece 78 is surrounded by a slit line 80 along its both side edges and lower edge so as to be able to be folded at a folding line 79 along its upper edge. Along the vertical folding line 71 between the inclined part 47 and the second side part 46*b*, a notch 75 is formed from the upper edge. Further. The second side part 46*b* is formed with an engaging piece 76 connected to an upper portion of its outer edge.

When the corrugated cardboard 60 is assembled into the vertical direction supporting part 26, first, the packaging material 60 is valley folded along the two center vertical folding lines 61. Then, each side wall 41 is valley folded along the two center vertical folding lines 71 and then the engaging piece 76 of the second side part 46*b* is engaged with the first engaging hole 62 of the end wall 42. In this manner, the side wall 41 is formed to have a dual structure by the first side part 46*a* and the second side part 46*b* opposing each other via the inclined part 47. At this time, the coupling piece 78 of the first side part 46*a* and the through opening 77 of the second side part 46*b* oppose to each other.

Afterwards, the top wall 43 is valley folded along the horizontal folding line 65 with respect to the end wall 42 and the engaging piece 68 is valley folded along the horizontal folding line 67 with respect to the top wall 43. Then, the notches 69 formed at the top edge of the engaging piece 68 are engaged with the notches 75 formed between the inclined part 47 and the second side part 46*b* of each side wall 41. In this manner, the corrugated cardboard 60 is assembled into the vertical direction supporting part 26.

In order to couple the thus assembled positioning part 25 and the vertical direction supporting part 26 to each other, as shown in FIG. 4B, the positioning part 25 is supported with the opened face directed downward and the edge formed with the hook pieces 52 directed rearward. Then, the positioning part 25 supported at the above posture is inserted into the hollow space of the vertical direction supporting part 26 and then the side walls 31 of the positioning part 25 are respectively overlapped on the insides of the side walls 41 of the vertical direction supporting part 26. Then, the hook pieces 52 of the positioning part 25 are engaged with the second engaging holes 63 formed on the end wall 42 of the vertical direction supporting part 26. Further, through the through opening 77, the coupling piece 78 is folded inward along the folding line 79 of the vertical direction supporting part 26 and then engaged with the coupling opening 53 of the positioning part 25. That is, the hook pieces 52 of the positioning part 25 and the second engaging holes 63 of the vertical supporting part 26 and also the coupling opening 53 of the positioning part 25 and the coupling piece 78 of the vertical direction supporting part 26 are configured to form engagement parts by which the positioning part 25 and the vertical supporting part 26 are engaged with each other. By such engagement parts, the positioning part 25 and the vertical direction supporting part 26 are coupled to each other. In the coupled state, a front side end portion of the positioning part 25 protrudes forward through a space between the side walls 41 of the vertical direction supporting part 26.

When the post-processing device 1 is packaged in the packaging member 5 having the above-described construction, first, the pair of lower buffering members 22 are disposed at the left and right corners of the skid 11 and the pair of supporting members 3*b* of the leg part 3 of the post-processing device 1 is placed on an upper face of the pair of lower buffering members 22.

Afterwards, as shown in FIG. 1 and FIG. 2, the intermediate buffering member 23 is disposed between the pair of supporting members 3*b* and the coupling member 3*c* and is interposed between the post-processing device 1 and the skid 11. In more detail, a lower edge of the intermediate buffering member 23 is abutted against the bottom plate 11*a* of the skid 11. Then, as shown in FIG. 2, the top wall 43 of the vertical direction supporting part 26 is abutted against the front side upward inclined face R1 of the lower face 2*c* of the main body part 2. Further, the left and right upper corner portions of the end wall 42 are abutted against the inner upper corner portions R2 of the front side faces of the columns 3*a* of the leg part 3. Then, a lower portion of the end wall 42 is abutted against the front face R3 of the coupling member 3*c* of the leg part 3. Furthermore, the front edges of the side walls 31 of the positioning part 25 are abutted against the front sideplate 12*b* of the lid case 12. When the intermediate buffering member 23 is thus interposed, the main body part 2 of the post-processing device 1 is thereby supported in the vertical direction by the vertical direction supporting part 26. Also, the positioning part 25 prevents the forward movement of the vertical direction supporting part 26.

In addition, in the vertical direction supporting part 26, the inclined part 47 of each side wall 41 extends in an oblique lower direction from the lower face of the main body part 2 toward near the front side lower corner C of the skid 11 and abuts against the bottom plate 11*a*. Herein, as shown in FIG. 3, the inclined part 47 is formed so as to be parallel to a perpendicular line P passing a lower edge T on the lower corner C side of the packaging box 10 and a center of gravity of the post-processing device 1 when the packaging box 10 in which the post-processing device 1 is packaged is inclined around the lower edge T into a balanced posture.

After the intermediate buffering member 23 is interposed between the post-processing device 1 and the skid 11, the lid case 12 is inserted inside the skid 11. Then, the side plates 12*b* of the lid case 12 and the side plates 11*b* of the skid 11 are coupled with each other by joints. Subsequently, after opening the flaps 12*a* of the lid case 12, the pair of upper buffering members 21 are interposed between the left and right upper corners of the main body part 2 and the lid case 12 and then the flaps 12*a* are closed.

In the packaging box 10 in which the post-processing device 1 is packaged using the upper buffering members 21, the lower buffering members 22 and the intermediate buffering member 23, an impact applied to the post-processing device 1 due to a downward dropping is absorbed by the lower buffering members 22 and the intermediate buffering member 23. In particular, an impact applied to the main body part 2 of the post-processing device 1 is absorbed by the intermediate buffering member 23.

With reference to FIG. 3, an impact absorbing action of the buffering member 20 when the packaging box 10 is dropped obliquely with the front lower edge T dropped first will be described. Incidentally, as described previously, since the side plates 12*b* of the lid case 12 are inserted inside the side plates 11*b* of the skid 11, in actuality, the front lower corner C of the packaging box 10 is formed between the bottom plate 11*a* of the skid 11 and the side plate 12*b* of the lid case 12; and however, in the following description, conveniently, it is presupposed that the front lower corner of the packaging box 10 is formed between the bottom plate 11*a* and the front side plate 11*b* of the skid 11.

When the packaging box 10 is dropped obliquely, an impact applied to the post-processing device 1 is also absorbed by the pair of upper buffering members 21 and the pair of lower buffering members 22. In particular, an impact applied to the main body part 2 is mainly absorbed by the intermediate buffering member 23. In the intermediate buffering member 23, since the vertical direction supporting part 26 interposed between the main body part 2 and the bottom plate 11*a* is formed with the inclined part 47 that is parallel to the direction of the perpendicular line P passing the center of gravity of the main body part 2 in the oblique dropping posture, a rigidity against the oblique dropping direction is obtained and the main body part 2 can be therefore protected surely. Also, the main body part 2 is not only supported on the bottom plate 11*a* of the skid 11 by the vertical direction supporting part 26, but also supported on the front side plate 11*b* of the skid 11 via the positioning part 25 coupled with the vertical direction supporting part 26 and the front side plate 12*b* of the lid case 12. Therefore, the impact applied to the main body part 2 is dispersed and then absorbed into the vertical direction supporting part 26 and the positioning part 25. Incidentally, the positioning part 25 maybe formed such that the lower edges of the side walls 31 abut against the bottom plate 11*a* of the skid 11 and then the lower corner edges of the side walls 31 abut against the lower corner C. Further, the vertical direction supporting part 26 may be formed such that the inclined part 47 abuts against the lower corner C. In this case, the positioning part 25 can be formed so as to abut against only the front side plate 12*b* of the lid case 12 without causing the positioning part 25 to abut against the bottom plate 11*a* of the skid 11.

As described hereinabove, the packaging member 5 of the present disclosure can surely protect an article to be packaged, such as the post-processing device 1 having a high center of gravity, at the time of oblique dropping because of its high rigidity against the oblique dropping direction.

In addition, the positioning part 25 and the vertical direction supporting part 26 are respectively formed by folding the corrugated cardboards 50, 60. Accordingly, the positioning part 25 and the vertical direction supporting part 26 can be simply and inexpensively formed without an increase in the number of parts or the assembling steps in comparison with a conventional buffering member interposed between the main body part and the bottom face of the packaging box. Further, since the positioning part 25 and the vertical direction supporting part 26 can be formed depending on the position and height or shape of the main body part 2, it easy to adapt to post-processing devices 1 of various shapes. In addition, since the hook pieces 52 and the coupling openings 53 of the positioning part 25 are engaged with the second engagement holes 62 of the end wall 42 and the coupling pieces 78 of the side walls 41 of the vertical supporting part 26 respectively, it makes possible to improve the rigidity of the intermediate buffer member 23.

Incidentally, in a case where the packaging box 10 drops obliquely from a rear side corner or left or right side corners, an impact applied to the post-processing device 1 can be absorbed by the pair of upper buffering members 21 and the pair of lower buffering members 22. Also, in a case where the packaging box 10 falls down forward, since the intermediate buffering member 23 is interposed between the main body part 2 and the leg part 3, and the front side plate 12*b* of the lid case 12, the impact applied to the main body part 2 and the leg part 3 can be absorbed.

In addition, since the end wall 42 of the vertical supporting part 26 has the reverse trapezoid shape, it becomes possible to disperse an abutment portion of the end wall 42 against the post-processing device 1. In detail, as shown in FIG. 3, the end wall 42 can abut against the inner upper corner portions R2 of the front side faces of the columns 3*a* of the leg part 3 and the front face R3 of the coupling member 3*c* of the leg part 3. By dispersing the abutment portion of the end wall 42, an impact applied to the post-processing device 3 can be dispersed and buffered.

In addition, although in the embodiment, the intermediate buffering member 23 is formed by combining two members of the positioning part 25 and the vertical direction supporting part 26 with each other, the intermediate buffering member may be formed of one packaging material. Further, although in the intermediate buffering member 23 of the embodiment, the shape of the endwall 42 of the vertical direction supporting part 26 is formed into the inverted trapezoidal shape in accordance with the shape of the post-processing device 1, the shape of the end wall 42 and the side wall 41 may be appropriately changed in accordance with the shape of the post-processing device 1.

In the embodiment, although the packaging box 10 has a configuration having the skid 11 and the lid case 12, the configuration of the packaging box 10 is not limited thereto but is applicable to a corrugated cardboard box having a conventional structure.

Furthermore, although the embodiment is described as to the post-processing device 1 as an article to be packaged, it is possible to apply to an industrial equipment or a household electric appliance having a high center of gravity.

While the preferable embodiment and its modified example of the packaging member of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A packaging member comprising:

a packaging box configured to house an article to be packaged and having a bottom plate and a side plate erected from one edge of the bottom plate, the article having a main body part and a leg part configured to support the main body part and an intermediate buffering member provided in a space formed between the bottom plate and the side plate of the packaging box and the main body part of the article, housed in the packaging box, inside of the packaging box;

wherein the intermediate buffering member includes:

a vertical direction supporting part abutting against a lower face of the main body part of the article housed in the packaging box and the bottom plate; and a positioning part coupled with the vertical direction supporting part and preventing the vertical direction supporting part from being moved toward the side plate, and wherein the vertical direction supporting part has an inclined part extending from the lower face of the main body part of the article housed in the packaging box in an oblique lower direction toward near a lower corner between the bottom plate and the side plate and abutting against the bottom plate, wherein the packaging box has a lid case configured to cover an upper face of the article housed in the packaging box, the lid case has a side plate inserted inside the side plate of the packaging box, and the positioning part abuts against the side plate of the lid case.

2. The packaging member according to claim 1, wherein, when the packaging box in which the article is housed is inclined around an edge on a side of the lower corner between the bottom plate and the side plate into a balanced position at which a center of gravity of the article housed in the packaging box is positioned on a perpendicular line passing through the lower corner side edge, the inclined part is formed so as to be parallel to the perpendicular line.

3. The packaging member according to claim 1, wherein the article is a post-processing device including a main body part configured to carry out post-processing on a sheet on which an image is formed; and a leg part configured to support the main body part, and wherein the vertical direction supporting part abuts against the lower face of the main body part of the post-processing device housed in the packaging box and the bottom plate.

4. A packaging member comprising:

a packaging box configured to house an article having a bottom plate and a side plate erected from one edge of the bottom plate, the article having a main body part and a leg part configured to support the main body part, and an intermediate buffering member provided in a space formed between the bottom plate and the side plate of the packaging box and the main body part of the article housed in the packaging box, inside of the packaging box;

wherein the intermediate buffering member includes:

a vertical direction supporting part abutting against a lower face of the main body part of the article housed in the packaging box and the bottom plate; and a positioning part coupled with the vertical direction supporting part and preventing the vertical direction supporting part from being moved toward the side plate, and wherein the vertical direction supporting part has an inclined part extending from the lower face of the main body part of the article housed in the packaging box in an oblique lower direction toward near a lower corner between the bottom plate and the side plate and abutting against the bottom plate, the packaging member further comprising:

an upper buffering member interposed between an upper portion of the main body part of the article housed in the packaging box and the packaging box; and a lower buffering member interposed between the leg part of the article housed in the packaging box and the packaging box.

5. A packaging member comprising:

a packaging box configured to house an article having a bottom plate and a side plate erected from one edge of the bottom plate, the article having a main body part and a leg part configured to support the main body part; and an intermediate buffering member provided in a space formed between the bottom plate and the side plate of the packaging box and the main body part of the article housed in the packaging box, inside of the packaging box;

wherein the intermediate buffering member includes:

a vertical direction supporting part abutting against a lower face of the main body part of the article housed in the packaging box and the bottom plate; and a positioning part coupled with the vertical direction supporting part and preventing the vertical direction supporting part from being moved toward the side plate, and wherein the vertical direction supporting part has an inclined part extending from the lower face of the main body part of the article housed in the packaging box in an oblique lower direction toward near a lower corner between the bottom plate and the side plate and abutting against the bottom plate, wherein the positioning part and the vertical direction supporting part are respectively formed by folding different packaging materials, wherein the positioning part has:

side walls opposing to each other; and a top wall provided between upper edges of the side walls, the vertical direction supporting part has:

dual structured side walls opposing to each other, the side wall being formed with the inclined part on its end face;

an end wall provided between one side edges of the side walls; and a top wall provided between upper edges of the side walls, and wherein the positioning part and the vertical direction supporting part are coupled with each other by inserting the positioning part into a hollow space surrounded by the side walls, the end wall and the top wall of the vertical direction supporting part and then engaging the positioning part and the vertical direction supporting part with each other.

6. The packaging member according to claim 5, wherein the end wall of the vertical direction supporting part has an inversed trapezoidal shape.

7. The packaging member according to claim 5, wherein the end wall of the vertical direction supporting part abuts against the leg part of the article housed in the packaging box.

8. The packaging member according to claim 5, wherein the positioning part has engagement parts which engage with the side walls and the end wall of the vertical direction supporting part.

* * * * *